US005197619A

United States Patent [19]

Margaria

[11] Patent Number: 5,197,619

[45] Date of Patent: Mar. 30, 1993

[54] DEVICE FOR CLOSING, WITH A SECURITY SEAL, A CONTAINER OF A RIGID MATERIAL, SUCH AS GLASS, BY MEANS OF A SCREW CAP OF RIGID THERMOPLASTICS MATERIAL

[75] Inventor: Mario Margaria, San Damiano D'Asti, Italy

[73] Assignee: Alplast S.p.A., Asti, Italy

[21] Appl. No.: 768,210

[22] PCT Filed: Apr. 10, 1990

[86] PCT No.: PCT/EP90/00561

§ 371 Date: Sep. 30, 1991

§ 102(e) Date: Sep. 30, 1991

[87] PCT Pub. No.: WO90/11944

PCT Pub. Date: Oct. 18, 1990

[30] Foreign Application Priority Data

Apr. 13, 1989 [IT] Italy ..... 67271 A/89

[51] Int. Cl.[5] ..... B65D 41/34; B65D 41/04

[52] U.S. Cl. ..... 215/256; 215/253; 215/258

[58] Field of Search ..... 215/252, 254, 256, 329, 215/330, 331, 258

[56] References Cited

U.S. PATENT DOCUMENTS 4,417,666 11/1983 Roberts ..... 215/256

FOREIGN PATENT DOCUMENTS 2913883 9/1980 Fed. Rep. of Germany ..... 215/330

*Primary Examiner*—Allan N. Shoap
*Assistant Examiner*—Paul A. Schwarz
*Attorney, Agent, or Firm*—Sughrue, Mion, Zinn, Macpeak & Seas

[57] ABSTRACT

The end wall of a screw cap of rigid thermoplastics material is provided with a sealing ring of heat-polymerized plastisol and the cylindrical skirt of the cap has an internal multiple thread at its upper end, an intermediate opening tear-strip and a lower part with an internal annular engagement rib which snap-engages under an annular rib of triangular cross-section situated below the thread of the threaded neck of a rigid container. The annular rib of the cap is interrupted in a plurality of zones and the neck of the container has a corresponding plurality of projections which extend downwards from the base of the triangular rib and, upon completion of the first screwing on of the cap, are each positioned in one of the interrupted zones of the rib of the cap, so as to prevent both a limited accidental unscrewing of the cap and the overtightening of the cap, and thus prevent the seal of the closure from being compromised in both cases.

4 Claims, 3 Drawing Sheets

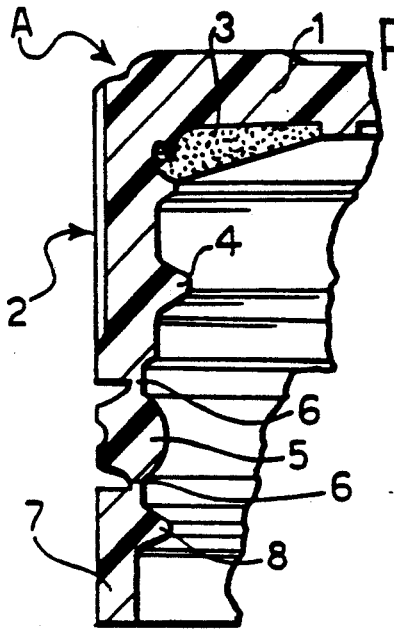
FIG. 4
FIG. 5
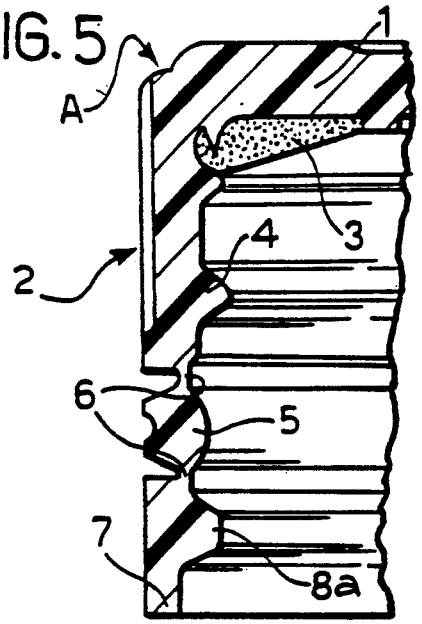
FIG. 6
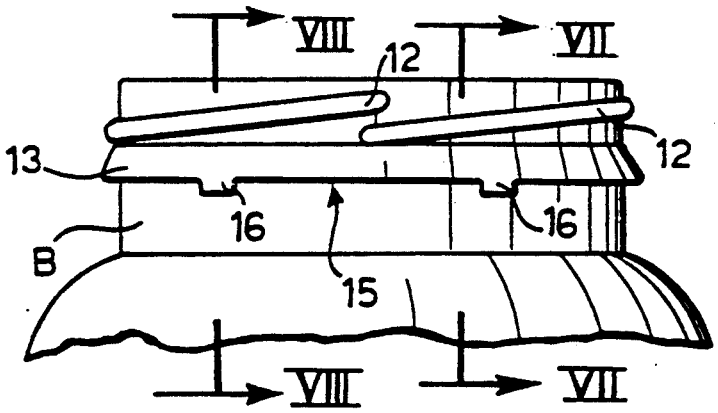
FIG. 7
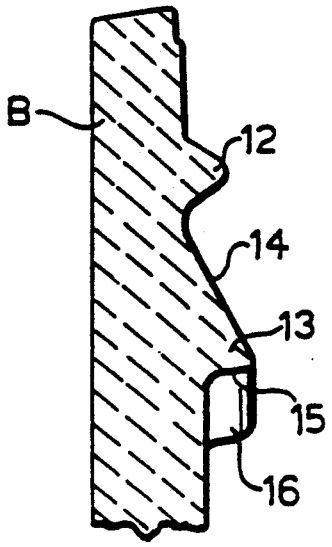
FIG. 8
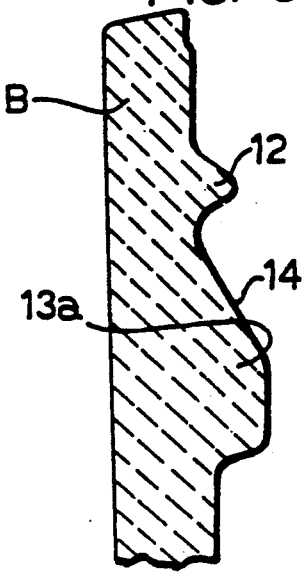

DEVICE FOR CLOSING, WITH A SECURITY SEAL, A CONTAINER OF A RIGID MATERIAL, SUCH AS GLASS, BY MEANS OF A SCREW CAP OF RIGID THERMOPLASTICS MATERIAL

BACKGROUND OF THE INVENTION

The subject of the present invention is a device for closing, with a security seal, a container of a rigid material, such as glass, by means of a screw cap of rigid thermoplastics material.

A closure device of the type specified is known from the published European application EP-A-0261645 by the same Applicant.

This closure device is used for closing glass containers used in the food industry for products which, after their introduction into the container and the application of the screw cap, are intended to undergo heat-treatment at a fairly high temperature in order to pasteurise the product or create a vacuum within the container.

In the practical use of a closure device of the type specified above, it has been found that the cap may be subjected to partial unscewing from the position to which it was originally screwed by means of a screw-capping machine in order to achieve a degree of deformation of the sealing ring and ensure the seal.

This partial unscrewing is permitted by resilient extension of the weakened zones connecting the tear-strip to the skirt of the cap due to tensile stress, and is sufficient to compromise the seal of the sealing ring, with a consequent loss of the vacuum produced in the container which prejudices the long-term preservation of the food product in the container.

The unscrewing may, for example, be caused accidentally by a person handling a container displayed in a large shop.

The seal of the closure may also be compromised if, as a result of the incorrect adjustment of the screw-capping machine, the cap is overtightened when it is first screwed on to the container, whereby the sealing ring is damaged.

DE-A-2913883 discloses a device for closing a bottle for perfumes or the like by means of a screw cap of thermoplastics material, in which the bottle and the cap are of rectangular shape in plane view.

The cap is provided with a central internally threaded tubular portion having at its lower end two radially yielding segments each of which is provided on its inner surface with a central radial notch.

When the cap is screwed on the neck of the bottle, the two segments snap-engage beneath an annular rib of the neck and the central notch of each segment is engaged by a retaining rib which radially protrudes from the bottle neck under the annular rib, in order to ensure that in the screwed condition the flat side faces of the cap are flush with the corresponding side faces of the bottle and the cap is maintained in such angular position.

The closure disclosed in this document is not a tamper-proof closure, because the two segments of the cap do not form a security seal. Moreover each notch of the segments has a circumferential extent which corresponds to the circumferential extent of the respective retaining rib of the bottle, which would not allow correct screwing by means of a screw-capping machine of a cap having a sealing ring constituted by a plastisol poured in annular seat of the cap and polymerised by heating.

BRIEF DESCRIPTION OF THE DRAWINGS

Further characteristics and advantages of the present invention will become clear from the description which follows with reference to the appended drawings, provided by way of non-limiting example, in which:

FIG. 4 is a section taken on the line IV—IV of FIG. 2, on an enlarged scale;

FIG. 5 is a section taken on the line V—V of FIG. 2, on an enlarged scale;

FIG. 6 is a front elevational view of the upper part of a container which is to be closed by the cap shown in FIGS. 1 to 5;

FIG. 7 is a section taken on line VII—VII of FIG. 6, on an enlarged scale;

FIG. 8 is a section taken on line VIII—VIII of FIG. 6, on an enlarged scale;

DETAILED DESCRIPTION OF THE INVENTION

Figure 1:
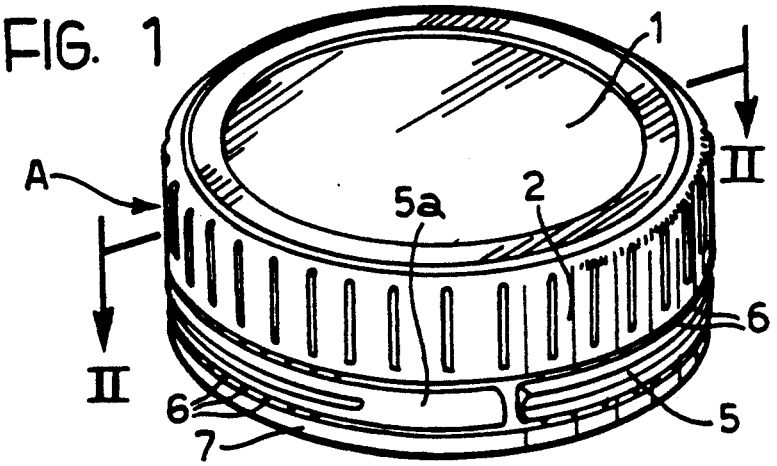
FIG. 1 is a perspective view of a screw cap usable as a closure device according to the invention.

With reference to FIGS. 1 to 5, a screw cap of a very-high-rigidity thermoplastics material, such as, for example, polypropylene filled with mineral fillers and having a hardness greater than 75 Shore D, is indicated A.

The cap is of the general type described in the European application EP-A-0261645 and has a horizontal end wall 1 and a cylindrical skirt 2.

The inner face of the end wall 1 is provided with an annular seat which hoses a sealing ring 3 constituted by a plastisol poured into the cap and polymerised by heating.

The upper part of the cylindrical skirt 2 has internal threading 4 with four threads, each of which has an angular extent of 90°. The skirt 2 has an intermediate part 5 which is connected to the skirt by means of weakened zones formed by links 6 and constitutes an opening tear-strip with a gripping zone 5*a*.

The skirt 2 also has a lower part 7 with an annular engagement rib 8 on its inner surface for snap-engagement beneath an annular rib on the neck of a container when the cap is first screwed on, so as to form a security seal.

Figure 2:
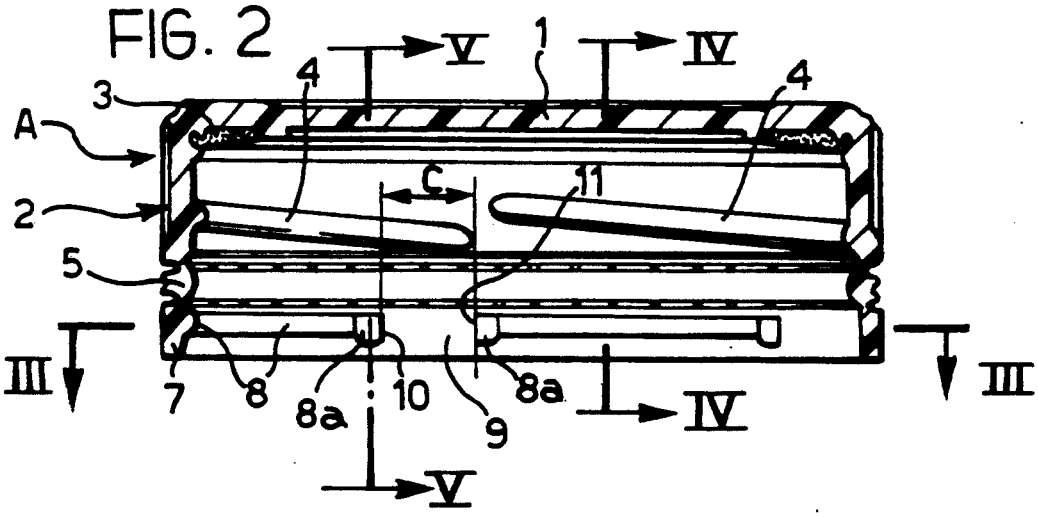
FIG. 2 is a vertical axial section taken on the line II—II of FIG. 1.
Figure 3:
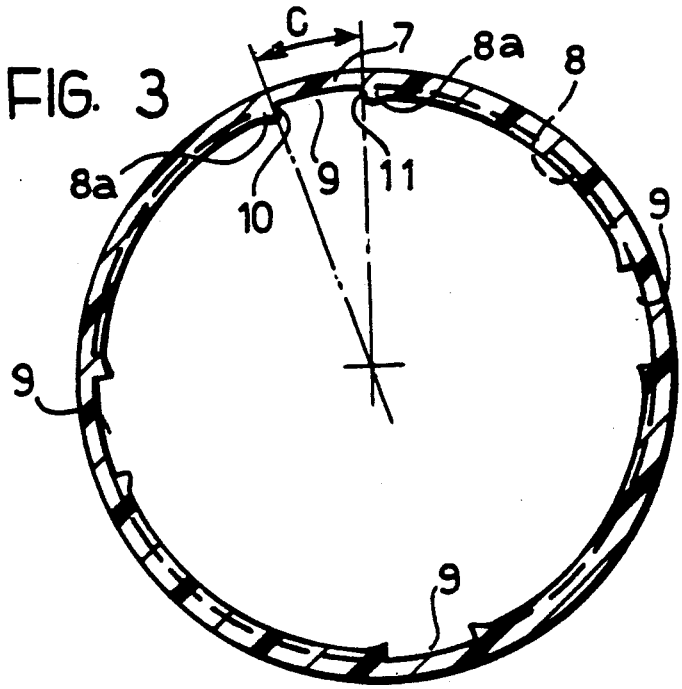
FIG. 3 is a cross-section taken on the line III—III of FIG. 2.

According to the present invention, the annular rib 8 is interrupted in four zones, indicated 9: each of the zones 9 has an angular extent C of 20° and, as can be seen from FIG. 2, is situated in correspondence with the last 20° of one of the threads 4 of the cap A.

The rib 8 has a portion 8*a* of enlarged cross-section adjacent each of the interrupted zones 9, and the interrupted zones 9 are each defined by two radial stop walls 10, 11 of the enlarged portions 8*a*.

With reference to FIGS. 6 to 9, the threaded neck of a container which is to be closed by the cap A described with reference to FIGS. 1 to 5 is indicated B.

The neck B has threading 12 with four threads, each with an angular extent of 90°, and has an annular rib 13 of substantially triangular cross-section below the threading.

The rib 13 has a downwardly-divergent, frusto-conical lateral surface 14 and a substantially radical, flat, annular base surface 15.

Below the rib 13, the neck B of the container is also provided with four equiangularly-spaced projections 16 which project radially from its cylindrical surface to form corresponding appendages extending axially downwards from the base 15 of the rib 13.

Figure 9:
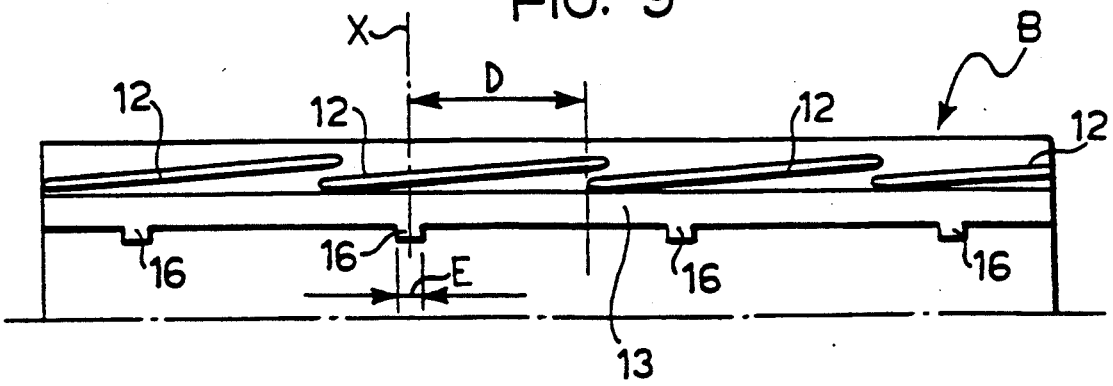
FIG. 9 is a development in a plane of the threaded neck of the container shown in FIG. 6.

As illustrated in FIG. 9, the central longitudinal axis X of each projection 16 is spaced from the start of one of the threads 12 by an angle D of approximately 60°.

The circumferential extent E of each projection 16 is approximately 7°–8°, that is, approximately one third of the angular extent of the interrupted zones 9 of the cap A.

Figure 10:
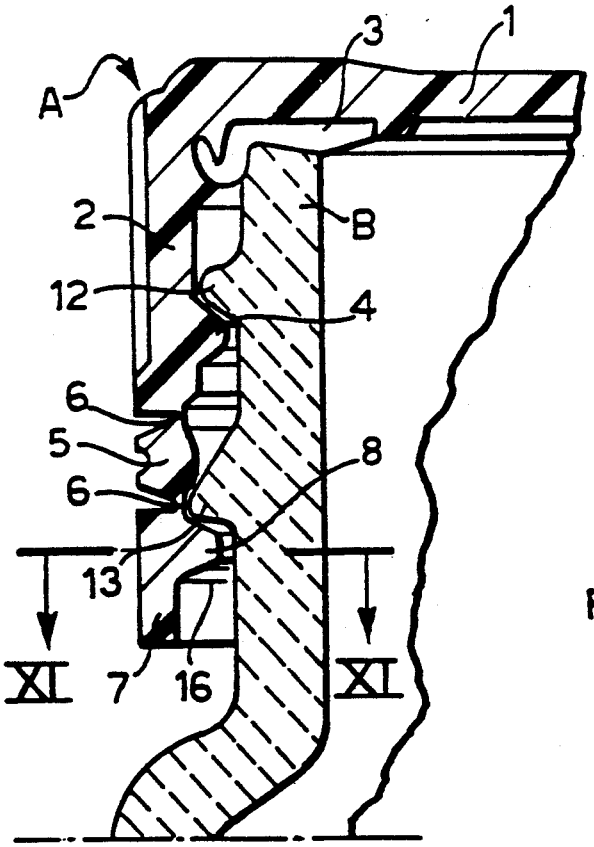
FIG. 10 is a vertical axial section on an enlarged scale, of a part of the container of FIG. 6 after the fitting of the closure cap shown in FIGS. 1 to 5.
Figure 11:
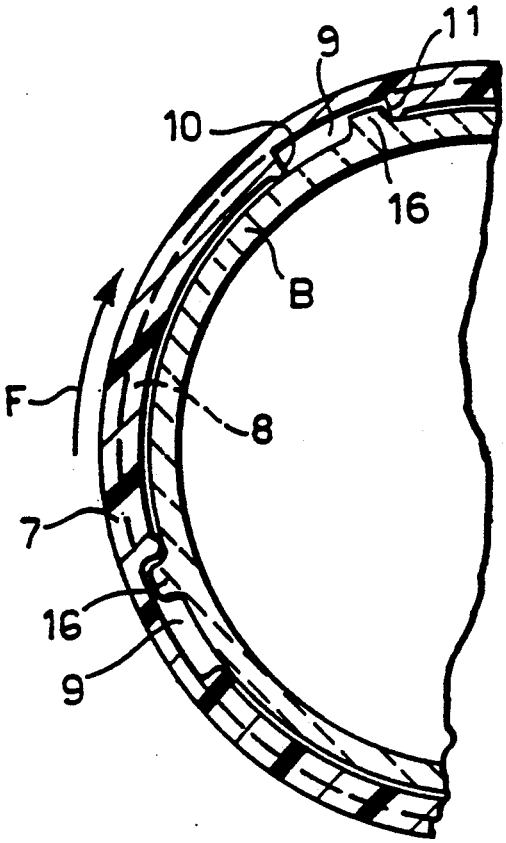
FIG. 11 is a cross-section taken on the line XI—XI of FIG. 10.

When the cap A is screwed on to the threaded mouth B of the container by means of a screw-capping machine, the parts are arranged in the positions shown in FIGS. 10 and 11.

As can be seen particularly from FIG. 11, in which the arrow F indicates the sense of screwing, each projection 16 is in contact with the leading radial wall 11 (in the sense of screwing) of one of the interrupted zones 9 of the rib 8 of the cap A.

Consequently, the projections 16 constitute an obstacle to the accidental partial unscrewing of the cap A which could compromise the seal effected by the sealing ring 3.

Moreover, the projections 16 prevent the accidental overtightening of the cap during the screwing-on stage (because of the incorrect adjustment of the screw-capping machine) such as to damage the sealing ring 3 and compromise the seal of closure. In fact, in this eventuality, the trailing radial wall 10 of the interrupted zone 9 would strike the respective projection 16 after a limited angular displacement of the cap from the position shown in FIG. 11, which would not be sufficient to compromise the seal.

The closure device according to the invention can also be used if the threading of the cap and the neck of the container have a number of threads other than four, for example, in the case of threading with six threads.

Moreover, the number of interrupted zones of the cap and of projections of the threaded mouth of the container may also be less than the number of threads. Thus, for example, in the case of quadruple threads, only two projections arranged at 180° may be used with two correspondingly-arranged interrupted zones.

I claim:

1. A closure device comprising in combination a container of a rigid material and a screw cap of rigid thermoplastics material, said container having a neck with a cylindrical outer surface provided with a multiple thread and an annular rib of substantially triangular cross-section below said thread, the rib comprising a downwardly-divergent frusto-conical lateral surface and a substantially-radial, annular, flat base surface, said cap having a horizontal end wall with an annular plastisol sealing ring disposed on an inner surface thereof and a cylindrical skirt with a corresponding internal multiple thread on an upper part, the cylindrical skirt having an intermediate part connected to the skirt by means of weakened zones and constituting an opening tear-strip and a lower part with an annular engagement rib on an inner surface which snap-engages beneath the triangular rib of the neck of the container when the cap is first screwed on, so as to form a security seal, wherein the threaded neck of the container has a plurality of equiangularly-spaced projections below the triangular rib each having a circumferential extent and projecting radially from said cylindrical outer surface of said neck and extending axially downwards from the base surface of the triangular rib, wherein the annular engagement rib of the cap is interrupted in a plurality of zones equal in number to the projections of the neck of the container, each of the interrupted zones having a circumferential extent substantially greater than the circumferential extent of each of the projections and each interrupted zone being defined by two radial stop walls and wherein the projections and the interrupted zones are angularly positioned relative to the threads of the neck and of the cap respectively, so that upon completion of the first screwing on of the cap, each projection is in one of the interrupted zones of the engagement rib of the cap and cooperates with one of the radial walls to prevent the cap from subsequently being partially unscrewed so as to compromise the seal of the closure, and in that the other radial wall of each interrupted zone of the cap constitutes a stop which reacts against the respective projection to prevent the cap from being accidentally overtightened such as to compromise the seal of the closure during its first screwing on.

2. A closure device according to claim 1, wherein the thread of the cap and the thread of the neck of the container each have four threads, each of which has an angular circumferential extent of 90°, wherein the plurality of projections on the threaded neck of the container is comprised of four projections with each projection having a central longitudinal axis spaced angularly in a circumferential direction by approximately 60° from a starting point of one of the threads of the threaded neck, and wherein the plurality of zones for said annular engagement rib of the cap is comprised of four interrupted zones, each of which has an angular circumferential extent corresponding to a 20° portion of one of the threads of the cap adjacent said engagement rib.

3. A closure device according to claim 1, wherein the annular rib of the cap has a portion of enlarged cross-section adjacent each interrupted zone.

4. A closure device according to claim 1, wherein each projection has a circumferential extent approximately one-third the circumferential extent of each interrupted zone.

* * * * *